US009307338B2

(12) United States Patent
Usher et al.

(10) Patent No.: US 9,307,338 B2
(45) Date of Patent: Apr. 5, 2016

(54) UPMIXING METHOD AND SYSTEM FOR MULTICHANNEL AUDIO REPRODUCTION

(71) Applicant: Dolby International AB, Amsterdam Zuidoost (NL)

(72) Inventors: John Usher, Barcelona (ES); Antonio Sole, Barcelona (ES)

(73) Assignee: Dolby International AB, Amsterdam Zuidoost (NL)

( * ) Notice: Subject to any disclaimer, the term of this patent is extended or adjusted under 35 U.S.C. 154(b) by 315 days.

(21) Appl. No.: 13/923,608

(22) Filed: Jun. 21, 2013

(65) Prior Publication Data

US 2014/0010375 A1 Jan. 9, 2014

Related U.S. Application Data

(63) Continuation of application No. 13/820,863, filed as application No. PCT/EP2010/005450 on Sep. 6, 2010, now abandoned.

(51) Int. Cl.

| | |
|---|---|
| ***H04R 5/00*** | (2006.01) |
| ***H04S 1/00*** | (2006.01) |
| ***H04S 5/00*** | (2006.01) |

(52) U.S. Cl.

CPC ..... *H04S 1/002* (2013.01); *H04S 5/005* (2013.01); *H04S 2400/05* (2013.01); *H04S 2400/07* (2013.01)

(58) Field of Classification Search

CPC ..... G10L 19/008; H04S 5/00; H04S 7/30; H04S 3/008

USPC ..... 381/17–22, 27, 307

See application file for complete search history.

(56) References Cited

U.S. PATENT DOCUMENTS

| | | | | |
|---|---|---|---|---|
| 5,610,986 | A | 3/1997 | Miles | |
| 2006/0045291 | A1 | 3/2006 | Smith | |
| 2006/0062396 | A1 * | 3/2006 | Jin | 381/19 |
| 2008/0031462 | A1 * | 2/2008 | Walsh et al. | 381/17 |

FOREIGN PATENT DOCUMENTS

| | | |
|---|---|---|
| EP | 0 621 737 A1 | 10/1994 |
| EP | 1 722 598 A2 | 11/2006 |

(Continued)

OTHER PUBLICATIONS

International Search Report for corresponding Application No. PCT/EP2010/005450 dated Apr. 27, 2011.

(Continued)

*Primary Examiner* — Alexander Jamal

(57) ABSTRACT

An audio signal enhancing device, and a corresponding method of enhancing stereophonic signals, is provided which generates an enhanced signal with improved spatial sound image quality for upmixing a stereophonic input signal. When used in combination with a centre channel processor or LFE processor, an improved processing of the input signals is provided resulting in final centre channel and at least one LFE sub-woofer channel wherein the problems and disadvantages of the prior art are resolved. The result is a centre and LFE signal that contains a stable, non time-smeared image with a high quality natural-sounding fidelity. These advantages are achieved especially for time-delayed or phase-panned stereo input signals, independently of whether they are matrix encoded or non-matrix encoded input signals.

18 Claims, 10 Drawing Sheets

(56) References Cited

FOREIGN PATENT DOCUMENTS

| | | | |
|---|---|---|---|
| JP | 2008 048324 | A | 2/2008 |
| RS | 1332 | U | 4/2013 |
| WO | 2008/023178 | A1 | 2/2008 |

OTHER PUBLICATIONS

"D-Cinema Distribution Master—Audio Channel Mapping and Channel Labeling", SMPTE 428-3-2006, Published by Society of Motion Picture and Television Engineers, Sep. 29, 2006.

T. Stanojevic et al., "The Total Surround Sound System", 86$^{th}$ AES Convention, Hamburg, Mar. 1989.

T. Stanojevic et al., "Designing of TSS Halls", 13$^{th}$ ICCA, Belgrade, 1989.

T. Stanojevic et al., "TSS System and Live Performance Sound", 88$^{th}$ AES Convention, Montreux, Mar. 1990.

T. Stanojevic, "3-D Sound in the Future HDTV Projection Halls", 132$^{nd}$ SMPTE Technical Conference and Equipment Exhibit, New York, Oct. 1990.

T. Stanojevic et al., "Some Technical Possibilities of Using the TSS Concept in the Motion Picture Technology", 133$^{rd}$ SMPTE Technical Conference and Equipment Exhibit, Los Angeles, Oct. 1991.

T. Stanojevic et al., "TSS Processor", 135$^{th}$ SMPTE Technical Conference and Equipment Exhibit, Los Angeles, Oct. 1993.

T. Stanojevic, "Virtual Sound Sources in the Total Surround Sound System", 137$^{th}$ SMPTE Technical Conference and World Media Expo, New Orleans, Sep. 1995.

TSS Processor, SMPTE Journal, Nov. 1994.

Surround Sound for a New Generation of Theaters, Sound & Video Contractor, Dec. 1995.

* cited by examiner

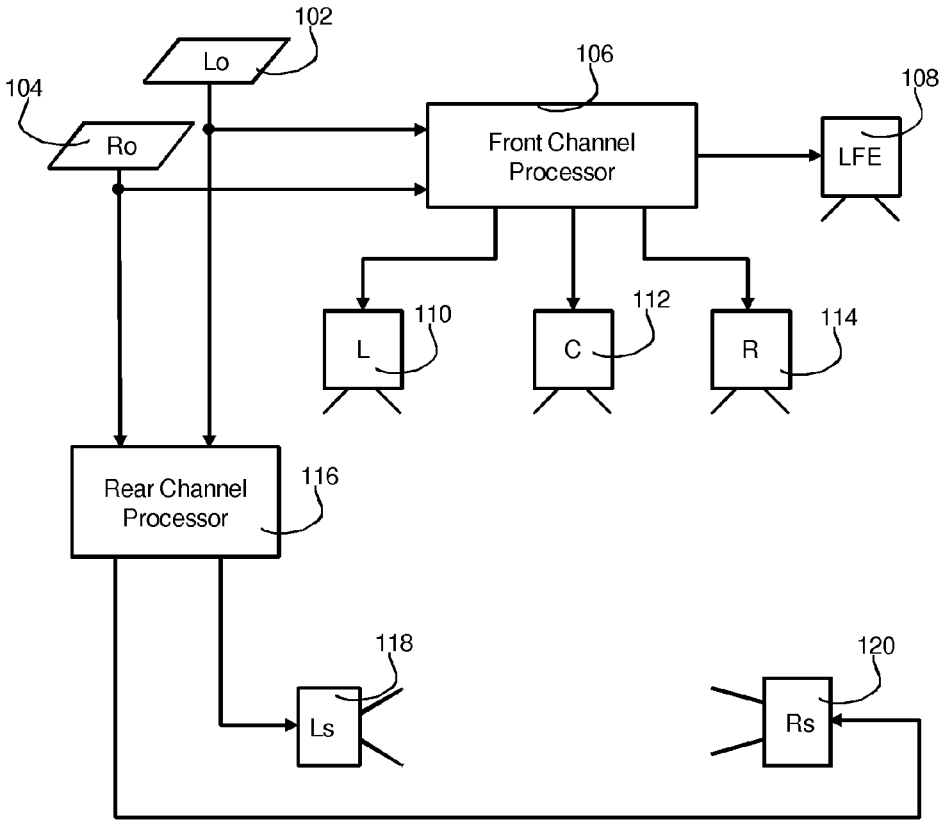
FIG. 1A – PRIOR ART –
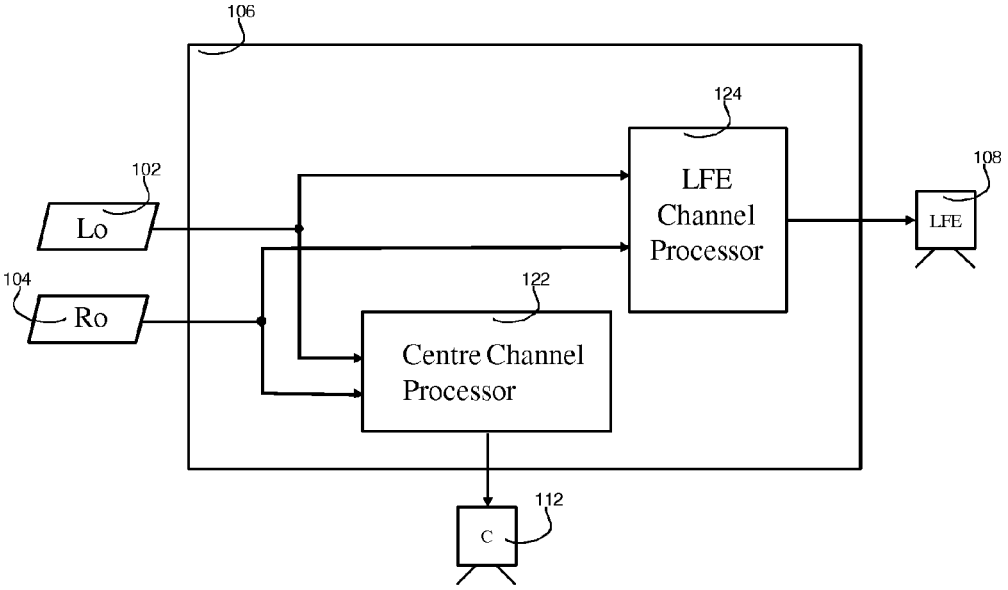
FIG. 1B – PRIOR ART –

UPMIXING METHOD AND SYSTEM FOR MULTICHANNEL AUDIO REPRODUCTION

This application is a continuation of U.S. patent application Ser. No. 13/820,863 filed Mar. 5, 2013, which is a U.S. National Phase Application of PCT/EP2010/005450 filed Sep. 6, 2010, which is hereby incorporated herein by reference in its entirety.

BACKGROUND

1. Technical Field

The present invention relates generally to signal processing for audio applications and more specifically to a novel and improved audio upmixer and method for upmixing stereophonic audio channels.

2. Description of the Related Art

Current audio applications have developed from the standard 2-channel stereophonic audio playback systems to more complex systems wherein different effects are achieved, and different sensations provided, via the use of a number of loudspeakers. Not only has the number of loudspeakers increased, but also the number of features of each loudspeaker, with varying characteristics, yielding throughout the years increasingly varied professional and domestic loudspeaker systems.

These multichannel implementations have also evolved to include "surround-sound" effects. Such surround-sound loudspeaker audio systems are today found in theatres, music auditoria, automobiles, and domestic theatre and computer systems, amongst others. However these implementations typically comprise a wide variety of individual full-range loudspeakers and sub-woofers, each with their own sound characteristics and input/output responses.

Additionally, there are also a wide variety of types of audio signals which are being reproduced, as music, film soundtrack or voice sources are all being processed. However, to provide the optimum mixing of input signals for a given loudspeaker configuration requires laborious and skilled manual signal processing operations, comprising filtering and mixing by skilled technicians.

Audio upmix, or upmixer, systems have been proposed in order to effectively upmix N original audio signals into M upmixed audio signals, where M>N. For instance, systems exist which generate at least two surround audio channels. Other prior art systems produce two surround channels which detect hard-panned sources and ensure that voice signals will always be located in the front channels even if they exist in only one input channel.

More commonly however, upmixing systems for home or professional theatre systems are usually configured to generate 3 front loudspeaker signals, 2 surround signals, and a low frequency effects, LFE, or subwoofer, signal to drive a subwoofer loudspeaker, as represented in FIG. 1A. The 3 front loudspeaker signals are normally used for outputting all sound types, including voice, the 2 surround signals for producing ambient sounds and the LFE subwoofer signal is used to generate low frequency special effects. This combination results in an enhanced experience for the end user due to the different sound components being generated in the different loudspeakers. In particular, the sound imagery is enhanced because sound images are located around the listening area, giving a more natural enveloping imagery compared with reproduction on two frontal loudspeakers.

These systems normally comprise audio matrix coding and decoding operations. Matrix decoding is a type of adaptive or non-adaptive audio upmixing whereby a higher number of output audio signals (e.g. 6 for a 5.1 system) is decoded from a smaller number (typically 2) of input signals. However systems comprising non-matrix coding and decoding also exist.

A disadvantage of these prior art systems is apparent when input signals containing audio generated using phase affects, such as a low frequency component that is 180 degrees out of phase in one input channel relative to the other, are used as inputs to the upmixers. Such phase inversion mixing is a very common audio technique used in music and film audio production to give a wide spatial imagery. These phase inverted input signals are normally summed, and since the out of phase signals cancel each other out, no signal is present in the LFE signal. Therefore the desired sub-woofer effect is not achieved.

A further disadvantage of existing systems is that sound components originally only present in one input channel are generated as output also in the centre channel, therefore producing a non-realistic outputsound image. For instance, consider a musical audio signal corresponding to a recorded musical instrument present on only the left input channel. If the upmixed centre channel is generated by summing the input left and right channels, then this upmixed centre channel will also contain the recorded musical instrument signal. This is an undesirable effect as it should only be perceived on the left when auditioned: that is, the spatial sound image quality of the auditioned upmixed signal will be poor.

Other implementations deal with generating a centre channel upmix signal, however they are intentionally configured so that out-of-phase signals do not cancel each other out and will be eventually present in the upmixed centre channel. However such designs are sub-optimal in that the out-of-phase sound is normally intended as sound for special effects, to be output from the surround loudspeakers, or the LFE loudspeaker, but not from the centre channel. Since the intention of the special effect sound is not intended to be emitted from the centre channel, a degraded reproduction of the original sound results.

Another effect which audio signal processing equipments need to take into account is time-smearing. It is very common for music recordings, or speech recordings, from live conferences, or with live dialogue, in films and television, to use more than one microphone for the recording. Each microphone is normally physically positioned at different corners of the room. In this scenario, the sound being recorded happens to be physically closer to one microphone more than the others resulting in signals containing audio generated time-delay effects, due to the fact that the sound arrives in one microphone before the other. This effect is termed time-delay panning or time-smearing. When such signals are summed, or summed after a gain is applied to one or both signals, then the resulting summed signal will contain a time-smeared signal, or a signal with a temporally smeared image, which results in reduced sound quality due, in part, to out-of-phase sound artefacts. This effect can be readily understood if the signal to be recorded is simply a "click" sound. Since the click arrives in one channel before the other, then if a non-zero gain is applied to one or both channels and the result is summed, then two clicks will appear in the resulting summed channel. Again this results in a poor reproduction of the original sound image.

Hence prior art audio upmixing systems wherein the two-channel audio material comprises time-delay panned recordings suffer at least in part from a combination of these disadvantages, wherein the original sound is not reproduced with fidelity, wherein the reproduction of special effects is not optimally achieved, or the special effect is reproduced in the wrong loudspeaker. This combination results in an overall unnatural listening experience for the listener.

SUMMARY

It is therefore an object of the present invention to provide a solution to the above mentioned problems. In particular, it is the object of the present invention to provide an audio upmixer such that an improved front sound image is achieved.

According to one aspect of the invention an audio signal enhancing device, and a corresponding method of enhancing stereophonic signals, is provided which generates an enhanced signal with improved spatial sound image quality. When used in combination with a centre channel processor or low frequency effects subwoofer LFE processor, an improved processing of the input signals is provided resulting in final centre channel and at least one LFE sub-woofer channel wherein the problems and disadvantages of the prior art are resolved. The result is a centre and LFE signal that contains a stable, non time-smeared image with a high quality natural-sounding fidelity. These advantages are achieved especially for time-delayed or phase-panned stereo input signals, independently of whether they are matrix encoded or non-matrix encoded input signals.

Therefore, in this novel processing system and reproduction configuration a pair of audio signals is automatically upmixed for optimum reproduction via 3, or 5 or 7 full-range loudspeakers in combination with at least one 1, and even up to 3 sub-woofer signals. The upmixing method of the invention is tailored for high-quality low-latency audio signal processing for voice, music and film soundtrack audio sources.

According to one aspect of the invention, an audio signal enhancing device is defined for enhancing a stereophonic input signal comprising two audio signals to generate at least one enhanced signal.

According to another aspect of the invention, a method of enhancing a stereophonic input signal to generate at least one enhanced signal is provided.

According to another aspect of the invention, a centre channel generation device, and a corresponding method, for generating a centre channel signal from a stereophonic input signal comprising two audio signals is provided.

According to another aspect of the invention, a low frequency effects LFE subwoofer signal generation device, and a corresponding method, for generating a subwoofer signal from a stereophonic input signal comprising two audio signals is provided.

According to another aspect of the invention, audio signal upmixer, and a corresponding method, for generating at least three output audio signals from a stereophonic input signal comprising two audio signals is provided.

According to another aspect of the invention, a computer program, and a computer readable medium embodying the computer program, for performing the different functions of the different aspects and embodiments of the invention are provided.

The invention provides methods and devices that implement various aspects, embodiments, and features of the invention, and are implemented by various means. For example, these techniques may be implemented in hardware, software, firmware, or a combination thereof.

For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, or a combination thereof.

For a software implementation, the various means may comprise modules (e.g., procedures, functions, and so on) that perform the functions described herein. The software codes may be stored in a memory unit and executed by a processor. The memory unit may be implemented within the processor or external to the processor.

Various aspects, configurations and embodiments of the invention are described. In particular the invention provides methods, apparatus, systems, processors, program codes, and other apparatuses and elements that implement various aspects, configurations and features of the invention, as described below.

BRIEF DESCRIPTION OF THE DRAWING(S)

The features and advantages of the present invention will become more apparent from the detailed description set forth below when taken in conjunction with the drawings in which like reference characters identify corresponding elements in the different drawings. Corresponding elements may also be referenced using different characters.

FIG. 1A depicts an upmixing configuration of the prior art with 2 input channels and 6 output channels, or 5.1 output channels as it is also commonly known in the art.

FIG. 1B depicts details of the front channel processor of the prior art.

DETAILED DESCRIPTION

Figure 2A:
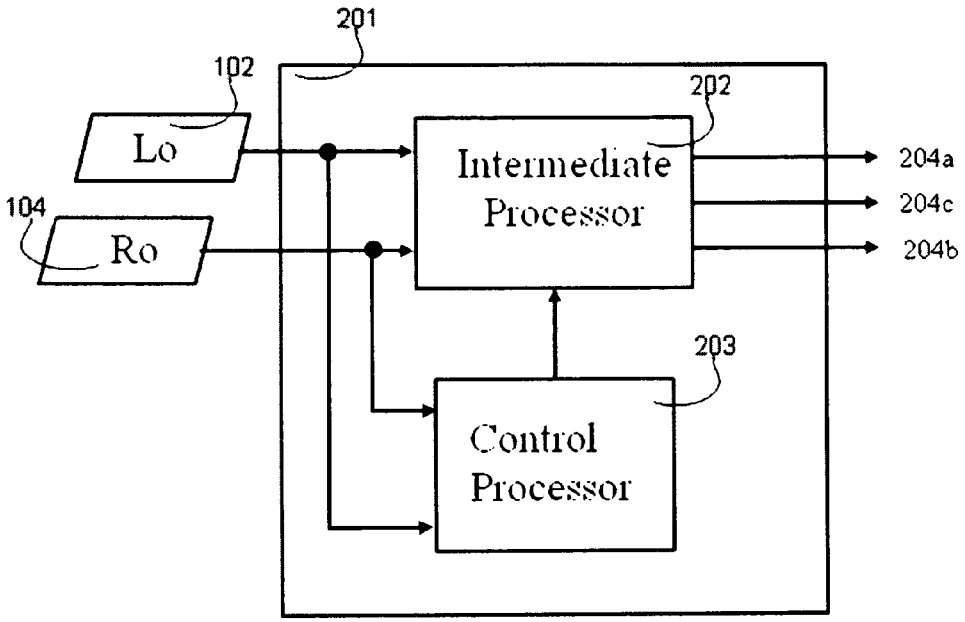
FIG. 2A depicts one embodiment of the present invention comprising details of the audio signal enhancing device for generating at least one enhanced signal from two audio signals.

In the following the words "low frequency effect" and "subwoofer" may be used in conjunction or interchangeably, as they both refer to the same feature, and can be summarised as "LFE". Therefore the upmixed output signal may be expressed as low frequency signal or channel, LFE signal or channel, subwoofer signal or channel, LFE subwoofer signal or channel or low frequency effects LFE subwoofer signal or channel, or any other combination.

From the following description, it will be understood by the person skilled in the art that although any one preferred aspect of the invention already provides solutions to at least some of the problems of the devices and methods of the prior art, the combination of multiple aspects herein disclosed results in additional synergistic advantageous effects over the prior art, as will be described in detail in the following.

FIG. 1A shows a simplified schematic of a configuration of a 5.1 upmixing loudspeaker system of the prior art, wherein two original left and right input audio signals Lo 102 and Ro 104 are upmixed to 6 new signals. Front channel processor 106 comprises, amongst other components, a centre channel processor 122 and an LFE channel processor 124 for generating the centre channel signal 112 and the subwoofer signal 108 respectively, as depicted in further detail in FIG. 1B. Therefore the front channel processor 106 processes the first input signal 102 and the second input signal 104 to yield at least four output signals, comprising a left 110, a centre 112, a right 114, and a low frequency effects LFE 108, or subwoofer, audio signal.

The generation of further channels, wherein up to at least ten channels may be upmixed from two input signals, may also be envisaged using the novel configuration of the present invention. Since one of the objectives of the present invention is to improve the quality of the centre channel and LFE channel processing, the teachings of the invention may be applied to any configuration, wherein at least 3 output signals are generated, as long as at least a centre channel or an LFE channel is also generated in addition to a left and a right output signal.

A rear channel processor 116 generates a pair of audio signals Ls 118 and Rs 120 that can be reproduced with rear "surround" loudspeakers. Since this invention does not relate to aspects of improving the surround-sound of prior art systems, the present disclosure does not further explain the details of the rear channel processor, or the rear channels. Those skilled in the art will realise that a workable surround-sound loudspeaker audio system includes a suitable combination of associated structural elements, mechanical systems, hardware, firmware and software that is used to support the function and operation of the surround-sound system.

As mentioned, the configuration of FIG. 1 suffers from the problems that the front channel processor of the prior art, or processors when implemented as a plurality of elements, are so configured that a time-smeared centre channel signal is generated, and since out-of-phase components cancel each other out, no, or very little, significant LFE audio is generated at the output of the subwoofer loudspeakers. Hence the original signal is degraded by the audio processing of the prior art resulting in an uncomfortable experience for the end-user.

The present invention solves the problems of the prior art by proposing a front channel processor comprising a novel audio signal enhancing device, as an intermediate stage, common to both centre channel and LFE channel processing, for generating enhanced intermediate signals. These enhanced signals are generated by taking into account the common sound components between the input signals, as the configuration of adaptive filters and delay lines, together with the dynamic setting of gain and filter coefficients, allows the correlated components of the input signals to be utilised and tuned according to the desired effect. In other words, the enhancing device mixes only the loudest level ("level" here applies to a relative voltage magnitude, e.g. level in dBV) of two filtered signals so that out of phase signals are not cancelled, and the resulting level of the output channel is proportional to the original low frequency content in the original input signals. This is achieved in part by determining a pair of optimum filters that are used to filter two input signals so that when summed, the resulting signal will not contain time-smearing and the levels of the dominant component (at a given frequency) is equal in both signals.

The audio signal enhancing device, when used in conjunction with a centre channel processor, results in a centre channel audio signal without any time-smearing which closely follows the input signal's level and reproduces the original sound image with fidelity. As mentioned, the adaptive filters align both the phase and magnitude of components in the input signals so that when the filtered signal is summed with the non-filtered signal, a summed signal is produced with minimal time-smearing artefacts and comprising a high ratio of correlated components to non-correlated components.

The audio signal enhancing device, when used in conjunction with an LFE channel processor, results in a subwoofer audio signal where, since only the loudest level of two filtered signals is output, out of phase signals are not cancelled and the resulting level of the output channel is proportional to the original low frequency content in the original input signals.

Therefore the enhancing device, when used in combination with a centre channel processor or LFE processor, results in improved centre channel and LFE signals wherein the problems of the prior art have been resolved. In particular, the centre and LFE signals contain a stable, non time-smeared image with a high quality natural sounding fidelity.

According to one aspect of the present invention, a front channel processor 106 comprises an audio signal enhancing device 201 as depicted in FIG. 2A. The enhancing device 201 comprises an intermediate processor 202 and a control processor 203. The intermediate processor 202, in conjunction with the control processor 203, processes the first input signal 102 and the second input signal 104 to yield at least one enhanced signal 204*a* to 204*c*.

Figure 2B:
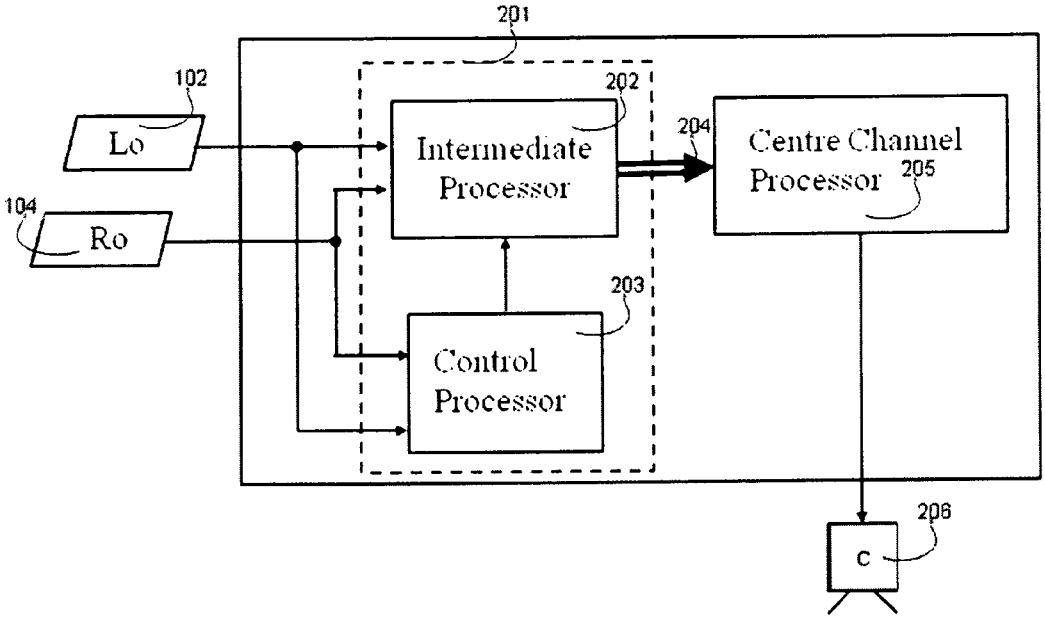
FIG. 2B depicts another embodiment of the present invention comprising details of the front channel processor for generating a centre channel signal.

According to one embodiment of the invention, as depicted in FIG. 2B, the front channel processor 106 comprises the audio signal enhancing device 201 in combination with a centre channel processor 205. The at least one enhanced signal 204 may be further processed by the centre channel processor 205 to yield a centre channel output signal 206.

Figure 2C:
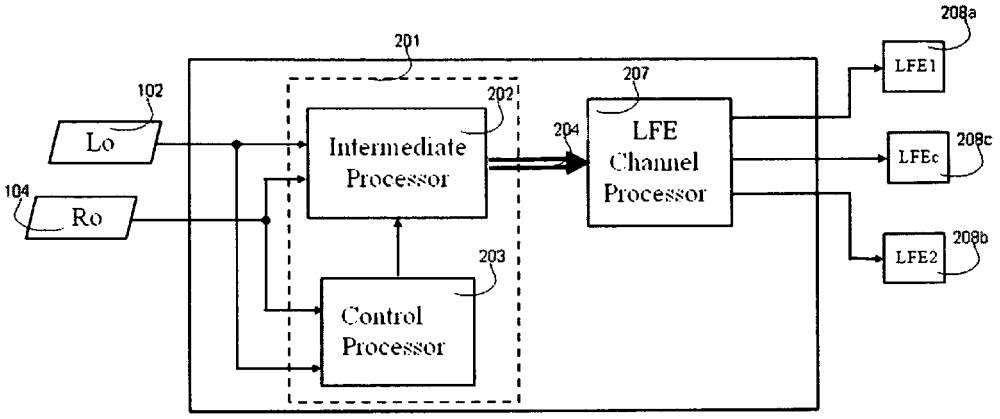
FIG. 2C depicts another embodiment of the present invention comprising details of the front channel processor for generating at least one, preferably three, subwoofer signals.

According to another embodiment of the invention, as depicted in FIG. 2C, the front channel processor 106 comprises the audio signal enhancing device 201 in combination with a LFE processor 207. The at least one enhanced signal 204 may be further processed by the LFE processor 207 to generate a single subwoofer signal 208*c*. Optionally, a plurality of these enhanced signals 204 may also be further processed by the LFE processor 207 to generate at least three output signals, a first LFE signal 208*a*, a second LFE signal 208*b*, and a third LFE centre signal 208*c*.

Figure 2D:
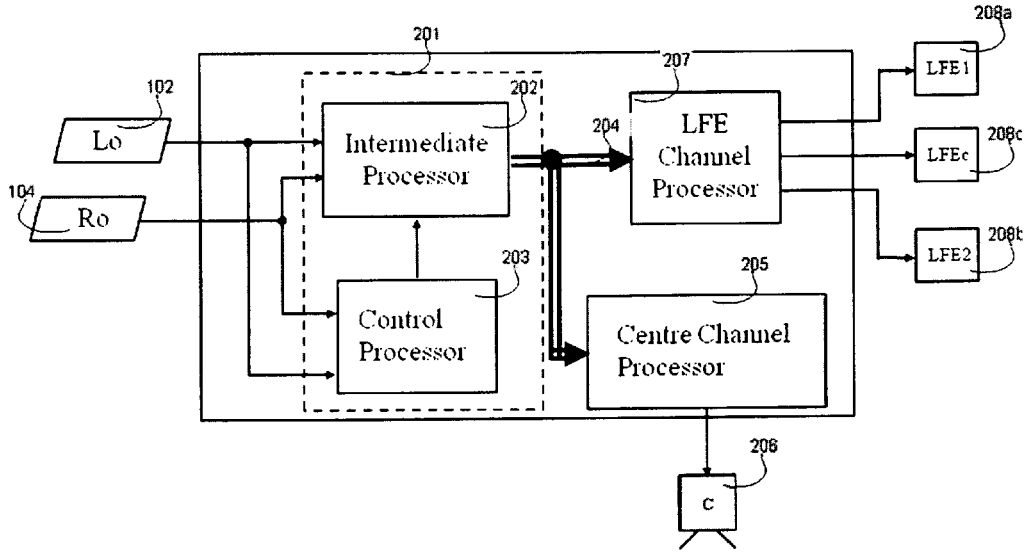
FIG. 2D depicts another embodiment of the present invention comprising details of the front channel processor for generating a centre channel signal and at least one, optionally three, subwoofer signals.

According to another embodiment of the invention, as depicted in FIG. 2D, the front channel processor 106 comprises the audio signal enhancing device 201 in combination with a centre channel processor 205 and LFE processor 207. The at least one enhanced signal 204 may be further processed by the LFE processor 207 to generate a centre channel signal 206 and a single subwoofer signal 208*c*, or a plurality of subwoofer signals 208*a*, 208*b* and 208*c*.

It will be readily apparent that the decision on the number and types of output signals is configurable. The equipment manufacturer, or the end user, may decide, depending on the specific environment wherein the upmixing system of the present invention will be implemented, whether a centre channel is generated or not, or whether an LFE channel is generated or not, and if it is, whether only one LFE channel or multiple LFE channels. Hence, the novel enhancing device 201 enables a high quality non-time smeared centre channel and at least one high quality special effects LFE channel to be generated respecting the original input signal fidelity enhanced with stable high quality subwoofer effects.

It will also be readily apparent that the intermediate processor 202 and control processor 203 may be separate components or may form part of a single processor. The control processor may also be a dedicated processor for controlling the operations necessary for generating the improved centre and LFE channels, or it may be a general purpose processor part of a broader upmixing system, which has tasks assigned to it of controlling the operations necessary for generating the improved centre and LFE channels.

The invention provides methods and devices that implement various aspects, embodiments, and features of the invention, and are implemented by various means. For example, these techniques may be implemented in hardware, software, firmware, or a combination thereof. The various different means or configurations for implementing the features of the invention may be embodied as components, modules, apparatus or systems. For example, for the case of a component, it may implement a process running on a processor, a processor, an object, an executable, a thread of execution, a program, and/or a computer. By way of illustration, both an application running on a computing device and the computing device can be a component. One or more components can reside within a process and/or thread of execution and a component may be localized on one computer and/or distributed between two or more computers. In addition, these components can execute from various computer readable media having various data structures stored thereon. In accordance with some aspects, a memory can be configured to retain and a processor can be configured to execute instructions relating to the functions and method steps of the invention.

Figure 3:
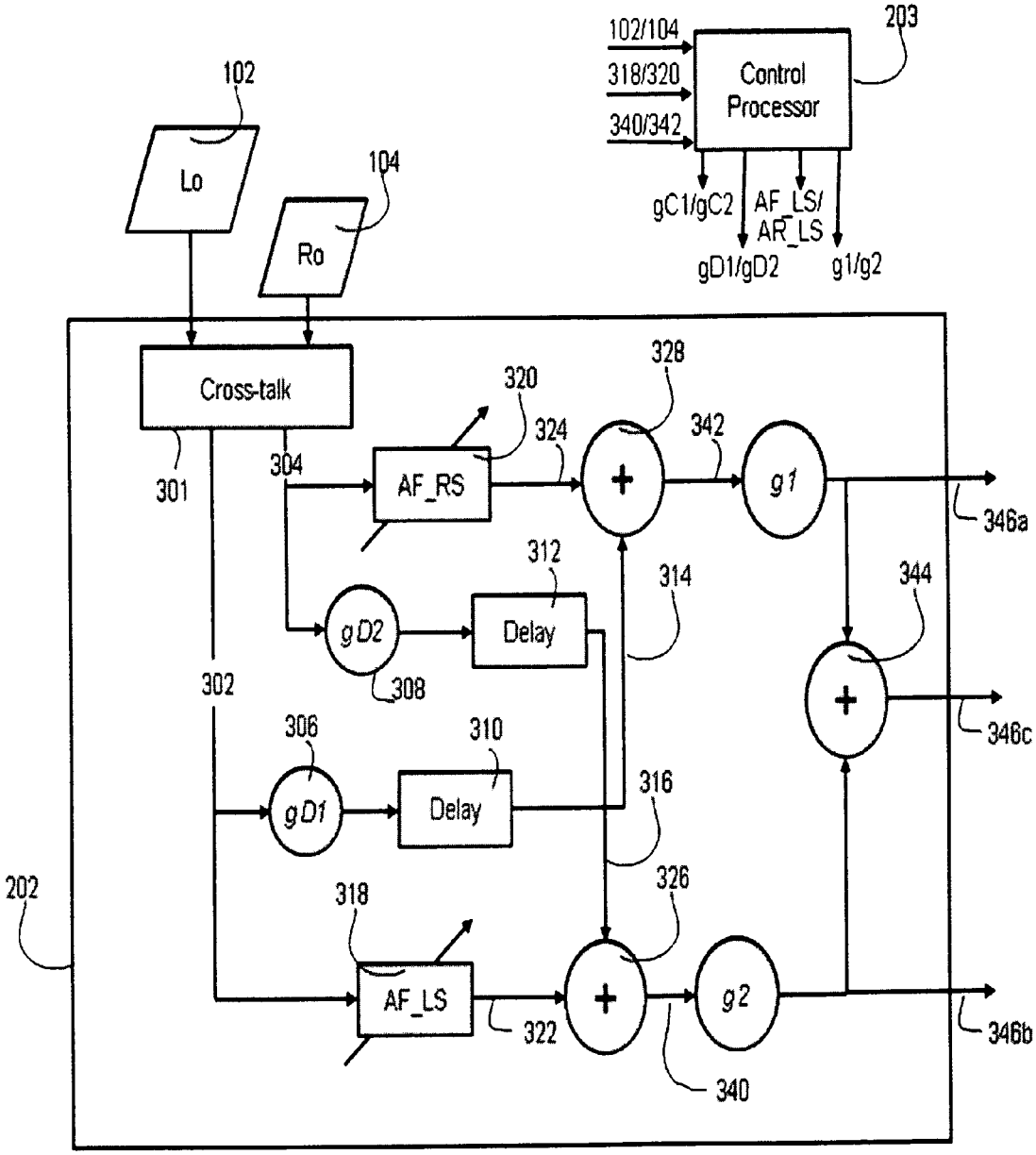
FIG. 3 depicts another aspect of the present invention, comprising details of the intermediate processor and the control processor.

FIG. 3 depicts in further detail the audio signal enhancing device 201 according to one aspect of the present invention. As depicted previously in relation with FIG. 2A, the enhancing device 201 comprises an intermediate processor 202 and a control processor 203. The intermediate processor 202 comprises a cross-talk stage 301 wherein a portion of the first input signal 102 is weighted using a gain coefficient gC1 and combined with the second input signal 104 yielding a third signal 302. Likewise, a portion of the second input signal 104 is weighted using a gain coefficient gC2 and combined with the first input signal 102 yielding a fourth signal 304. After the cross-talk stage two parallel processing lines are opened, each processing line comprising two processing branches. The first processing line includes a first processing branch comprising component 318 and a second processing branch comprising components 306 and 310. Likewise, second processing line includes a first processing branch comprising component 3320 and a second processing branch comprising components 308 and 312.

Continuing with the explanation of the intermediate processor 203, third signal 302 is weighted by gain coefficient gD1 306 and delayed in delay line 310 to yield a first delayed signal 314. Likewise fourth signal 304 is weighted by gain coefficient gD2 308 and delayed in delay line 312 to yield a second delayed signal 316. In parallel to the delay line operations, third 302 and fourth 304 signals are filtered by first adaptive filter 318 and second adaptive filter 320, respectively, to yield a first adapted signal 322 and a second adapted signal 324, respectively. Subsequently, the first adapted signal 322 is combined with the second delayed signal 316 in combiner 326 to yield first summed signal 340. Likewise, the second adapted signal 324 is combined with the first delayed signal 314 in combiner 328 to yield second summed signal 342. Finally first summed signal 340 and second summed signal 342 are each weighted by gain coefficients g1 and g2 respectively, thereby generating first 346*a* and second 346*b* enhanced signals. First and second enhanced signals are then combined in combiner 344 generating enhanced signal 346*c*. At least one of these enhanced signals 346 is used as input to centre channel processor 205 and/or LFE channel processor 207, depending on the final configuration or implementation.

Combiners 326, 328 and 344, also known as weighted summing units, perform a weighted summation operation, where output signal O is related to two input signals A and B via the expression O=x(A)+y(B), where x and y are gain coefficients, or weights, used to vary the contribution of each input signal to the addition of input signals A and B by a multiplication operation. In case of vectors this would be a vector dot product operation.

FIG. 3 also depicts the control processor 203 which is in communication with the various modules of the intermediate processor 202 and performs various analysis, monitoring, controlling and parameter setting operations as it uses the analysis results of various signals in order to achieve different advantageous effects. Control processor 203 analyzes at least one of the original input signals 102 or 104, at least one of the adaptive filter vectors AF_LS or AF_RS from first 318 or second adaptive filter 320, or at least one of the first and second summed signals from summing units 326 and 328. It subsequently uses these results to set various coefficients, amongst them, the gain coefficients gC1 and gC2 for the crosstalk stage, the gain coefficients gD1 and gD2 on the delay lines, the adaptive filter coefficients, or the gain coefficients g1 and g2.

In one aspect, the gain coefficients gC1 and gC2 of the cross-talk stage of the intermediate processor 202 are set in a first step by the control processor 203 to control how much one signal is added to the other in order to maintain the fidelity of the original signals. In order to respect the image of the original sound, control processor determines the amplitude and phase of each input signal and sets the gain coefficients accordingly, so that the end listener will have a natural experience.

In one configuration of the invention, the value of gC1 and gC2, which determines the degree of added cross-talk, is dependent on the level of the input signal correlation or the level difference ("level" here applies to a relative voltage magnitude, e.g. level in dBV) between the input signals. Correlation between two signals can be measured as the average cross-correlation between two input signal buffers, or as the maximum value over a given lag, for example, ±100 ms.

In another configuration, the correlation can be estimated from the magnitude of the adaptive filter tap coefficients. That is, for the case where the input signals are essentially uncorrelated the magnitude of the adaptive filters (for example, for a given tap of the filter frequency vector) will be essentially zero.

In another configuration, gC1 and gC2 are increased to a maximal value (e.g. −5 dB) when the input signals are highly uncorrelated (for example, when the running correlation is between −0.1 and 0.1) or when there is a large inter-channel level difference, for example, with an absolute level difference greater than 15 dB.

In another configuration gC1 and gC2 are equal to a value of approximately −30 dB for highly correlated signals (for example, when the absolute value of the running correlation is above 0.9), or when the inter-channel level difference is small, for example, with an absolute level difference less than 5 dB.

In one configuration, the gain coefficients of the delay lines gD1 and gD2 are set by the control processor 203 to control the ratio of correlated signal over uncorrelated signals. As mentioned previously, the value of gain gD1 306 may be identical or different to gain gD2 308 depending on the characteristics of the intermediate output signal 346 desired. The magnitude of these gains affects how much of the original input signals are summed with the signals filtered in the parallel adaptive filter lines. Since non-correlated information of the original signal are mixed with correlated components of the original signal that have been amplified by the adaptive filters, the gain acts as a control for the relative ratio of correlated versus non-correlated information that may appear at the output of the intermediate processor. In a first step the degree of correlation is ascertained, and in a second step and the gain and adaptive filter coefficients are subsequently set by the control processor 203 so that the delayed signals and the filtered signals are eventually matched.

Accordingly, if the gain is unity, then the output level of summing unit 326 or 328 will be approximately +6 dB for highly correlated signal components (that is, components that are strongly correlated in both the Lo 102 and Ro 104 input channels), but less for non-correlated components (due to random phase cancellations). In an embodiment, both gains 306 and 308 are the same and both delay lines 310, 312 apply the same delay.

In another aspect, the control processor 203 updates the coefficients of the adaptive filters so as to both minimize the level of the difference output signal and the correlation between the output signal and input signal. Either the Least Means Square LMS algorithm, or its derivative algorithms such as the Normalised LMS algorithm, may be used for this purpose. Implementing the NLMS in the frequency domain has the advantage that it is computationally less complex, however it may also be implemented in the time domain.

The steps of updating the adaptive filter using the NLMS algorithm for the generation of one of the first 322 or second 324 adapted signals is now described. The convolution of a first input signal x(n) (that is, the signal after the cross-talk has been added, for example signal 302) with an M-length adaptive filter h (for example, adaptive filter 318) gives signal ŷ(n):

$$\hat{y}(n) = \sum_{k=0}^{M-1} x(n-k)h_k = x^T(n)h. \tag{1}$$

where $$x(n) = [x(n), x(n-1), \ldots, x(n-M+1)]^T,$$

$$h = [h_0, h_1, \ldots, h_{M-1}]^T.$$

It is this filtered signal which approximates the non-filtered signal. The delayed input audio signal y(n) (for ŷ(n) example, signal 302) is then subtracted from the filtered signal ŷ(n) to give the error signal e(n) (for example, output signal 322):

$$e(n)=y(n)-\hat{y}(n). \tag{2}$$

The adaptive filter is adjusted over time so as to decrease the error signal level. This goal is formally expressed as a "performance index" or "cost" scaler J, where for a given filter vector h:

$$J(h)=E\{e^2(n)\}, \tag{3}$$

and E {•} is the statistical expectation operator. The requirement for the algorithm is to determine the operating conditions for which J attains its minimum value. This state of the adaptive filter is called the "optimal state". When a filter is in the optimal state, the rate of change in the error signal level (that is J) with respect to the filter coefficients h will be minimal. This rate of change (or gradient operator) is an M-length vector r, and applying it to the cost function J gives:

$$\nabla J(h) = \frac{\partial J(h)}{\partial h(n)}. \tag{4}$$

The right-hand-side of the last equations are expanded using partial derivatives in terms of the error signal e(n) from equation (3):

$$\frac{\partial J(h)}{\partial h(n)} = 2E\left\{\frac{\partial e(n)}{\partial h(n)} e(n)\right\}. \tag{5}$$

Updating the filter vector h from time sample (n−1) to time (n) is done by multiplying the negative of the gradient operator by a constant scaler and the filter update (i.e. the steepest descent gradient algorithm) is:

$$h(n) = h(n-1) + \frac{\alpha}{\delta + x^T(n)x(n)} x(n)e(n) \tag{6}$$

with $$0 < \alpha < 2.$$

where delta is a regularization constant to ensure against computational errors when the power estimate of the input signal is too low (this update version is called the Normalized LMS algorithm). Besides the massive increase in computational efficiency of implementing the filter-update and signal filtering in the frequency domain (requiring 5 FFT's per iteration; i.e. for every M input samples), the performance of the frequency domain and time domain NLMS algorithm are equivalent. In one embodiment, the overlap-save technique can be used with an overlap factor of two or four. In the filter update, the time-domain constraint (to ensure against "wrap-around" errors when M is less than the length of the actual impulse response) can be affected so as to weight later coefficients less than early ones; a modification known as the "exponential step" (ES) algorithm. This ensures an exponential decay of the impulse response.

In one configuration, for example when a centre channel signal is generated, gain coefficients g1 and g2 are set by the control processor 203 to a value of unity. In this configuration, the first and second enhanced signals are fed to the third combiner in equal proportions.

In one configuration, for example when LFE subwoofer signals are generated, gain coefficients g1 and g2 are set by the control processor 203. In one embodiment in which the control processor 203 analyses the input signals 102 and 104, gain coefficient g1 is set to a large value and gain coefficient g2 to a low value when the first input signal level is larger than the second input signal level (and vice versa) in order to amplify the strongest of the enhanced signals. In another embodiment in which the control processor 203 analyses the output of the adaptive filters, gain coefficient g1 is set to a large value and gain coefficient g2 is set to a low value when the relative phase of the adaptive filters differs by more than a predetermined amount, for example, 10 degrees phase angle. This configuration prevents distortion and time-smearing amongst the enhanced signals by keeping the phase differences within a predetermined range.

In another configuration, g1 and g2 are set to equal values, for example 0.5, but at least one adaptive filter is modified so that the relative phase of the two filters are equal. This can be achieved either by modifying the filter taps so that the imaginary component of one filter is shifted so that it matches the other filter, or by averaging the phase of both filters, or by a time-domain operation, whereby the peak of the time domain filter is shifted. Thus, the group delay of the adaptive filters would be modified such that the first 340 and second 342 summed signals are time-aligned at the input of the summer 344 thereby generating a non time-smeared intermediate output signal 346.

In another configuration, the control processor comprises logic for determining the point at which the control processor changes state, for example, from a first state where the first summed signal 340 has the highest signal level to a second state where the second summed signal 342 has the highest signal level. During state transitions it would be advantageous that the control processor slowly changes the gain of the two gain coefficients g1 and g2 for instance with such a time constant that it takes 500 ms to fade from one summed signal to the other. This gradual adjustment allows a smooth adjustment of sound contributions in the different channels, without interrupting the listening experience for the end user as well as minimising any distortion artefacts due to rapid gain changes.

In another configuration, the control logic comprises a hysteresis system to limit the minimum time interval at which the control logic changes state, which in one embodiment is 500 ms, as depicted in the process 900 of FIG. 9, which will be explained in further detail with reference to the preferred embodiments of the invention.

Therefore the combination of the intermediate processor 202 and control processor 203 yields various advantages by generating enhanced intermediate signals by taking into account the common sound components between the input signals, as the configuration of adaptive filters and delay lines, together with the dynamic setting of gain coefficients, allows the correlated components of the input signals to be utilised and tuned according to the desired effect. In other words, the enhancing device mixes only the loudest level ("level" here applies to a relative voltage magnitude, e.g. level in dBV) of two filtered signals so that out of phase signals are not cancelled, and the resulting level of the output channel is proportional to the original low frequency content in the original input signals. This is achieved in part by determining a pair of optimum filters that are used to filter two input signals so that when summed, the resulting signal will not contain time-smearing and the dominant component (at a given frequency) is equal in both signals.

Figure 4:
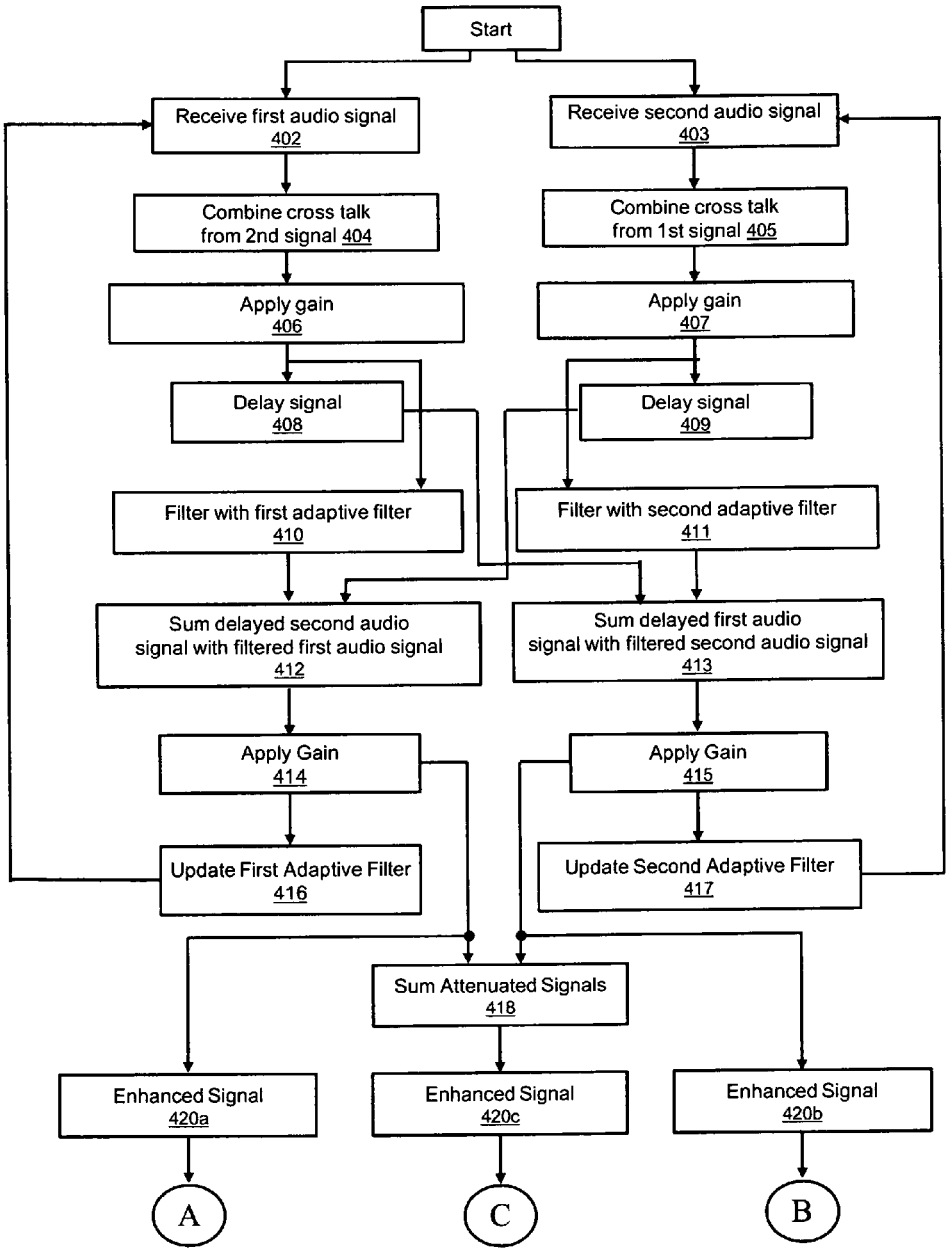
FIG. 4 is a flowchart representation of a method of producing an intermediate signal according to an aspect of the present invention.

FIG. 4 depicts an embodiment of the process 400 for generating an enhanced signal 204 according to the present invention. The process 400 is represented as functional blocks, which may be implemented by various means. For example, these techniques may be implemented in hardware, software, firmware, or a combination thereof. The left hand column of functional blocks may be considered to be a first parallel processing line whereas the right hand column of functional blocks may be considered to be a second parallel processing line.

Initially two original input signals 102, 104 corresponding to a first and second audio signal are received in block 402 and block 403 respectively. The two original input signals are each respectively processed by a cross-talk stage, in blocks 404 and 405, to combine a portion of the second signal 104 to the first signal 102 to generate a first cross-talk signal 302, and to combine a portion of the first signal 102 to the second 104 to generate a second cross-talk signal 304, where the level of the cross-talk component is determined by gain coefficients gC1 and gC2, wherein gC1<1 and gC2<1.

After the cross-talk stage 404 and 405, the first crosstalk signal 302 is modified, in block 406, with gain gD1 306 (where gain gD1 can be equal to any value between zero and unity) and delayed, in block 408, with a first delay unit 310, which in one embodiment of the invention is a delay equal to 10 ms, to generate a first delayed signal 314. Likewise, the second crosstalk signal 304 is modified, in block 407, with gain gD2 308 and delayed, in block 409, with second delay unit 312 to generate a second delayed signal 316.

In parallel to the gain and delay operations, the first crosstalk signal 302 is filtered, in block 410, using a first adaptive filter 318 to generate a first adapted signal 322 and the second crosstalk signal 304 is filtered, in block 411, using a second adaptive filter 320 to generate a second adapted signal 324.

In the first combiner 326, the first adapted signal 322 is combined, in block 412, with the second delayed signal 316 to generate a first summed signal 340. If gain gD2 is set to zero, then summing unit 326 directly passes the signal from filter 318. Likewise, in the second combiner 328, the second adapted signal 324 is combined, in block 413, with the first delayed signal 314 to generate a second summed signal 342. Again if gain gD1 is set to zero, then summing unit 328 directly passes the signal from filter 320.

Subsequently, in block 414 a first gain coefficient g1 is applied to the first summed signal 340 to generate first enhanced signal 420*a*. Likewise in block 415 a second gain coefficient g2 is applied to the second summed signal 342 to generate a second enhanced signal 420*b*. Both of these enhanced signals are finally combined in combiner 344 to generate a third enhanced signal 420*c*. These enhanced signals are used in combination with the centre channel processor 205 and LFE channel processor 207 to achieve the upmixed output signals of the present invention. At this point, the filter coefficients of the first 318 and second 320 adaptive filters are also updated as previously explained.

Therefore the process 400 yields at least one enhanced signal 420 which enables a high quality non-time smeared centre channel and at least one high quality special effects LFE channel to be generated respecting the original input signal fidelity enhanced with stable high quality subwoofer effects. The outputs A, B and C of this process 400 are linked to process 700 and process 900 for generating the centre channel signal and the at least one subwoofer channel signal.

Figure 5:
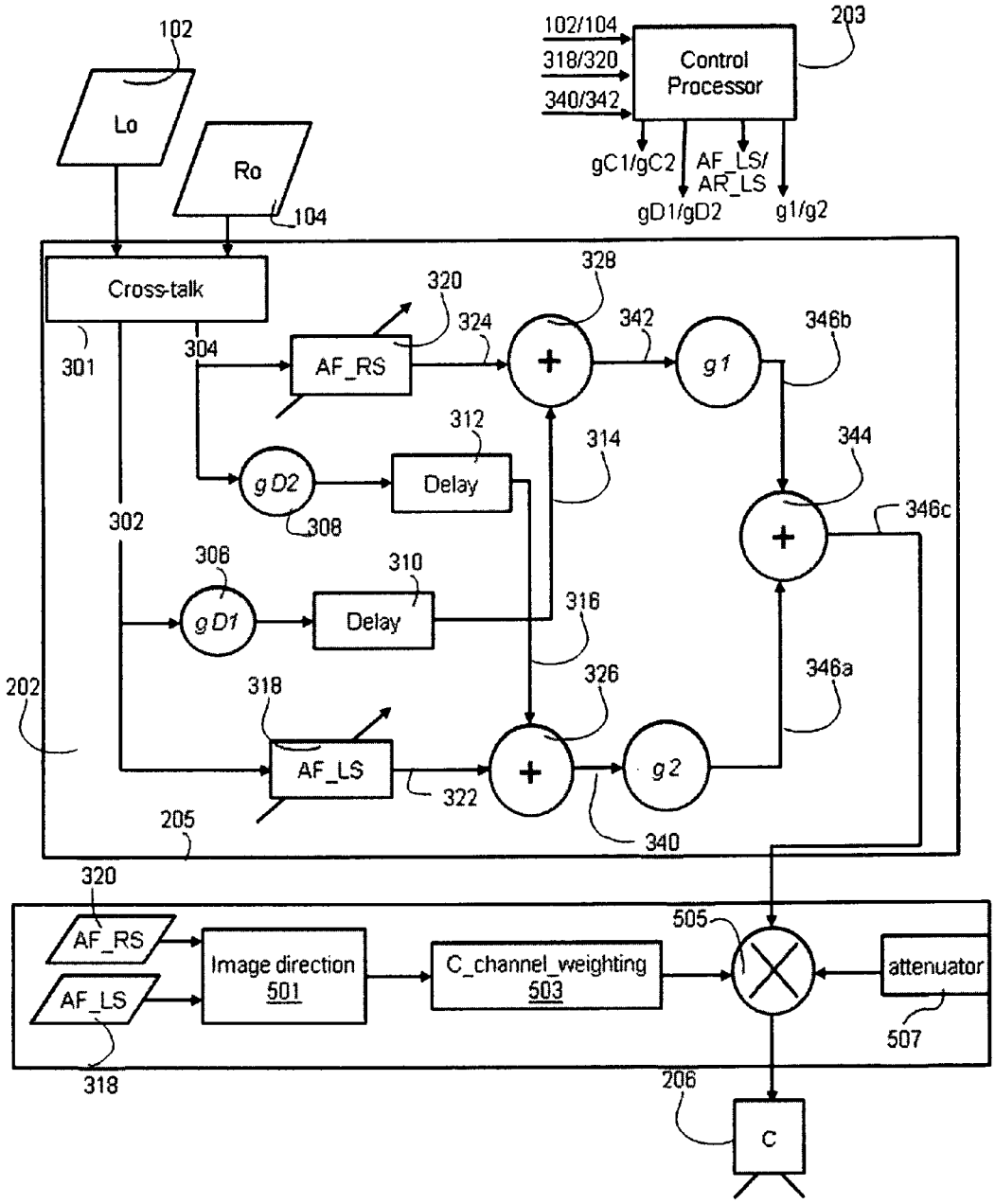
FIG. 5 depicts another aspect of the present invention, comprising details of the front channel processor for generating a centre channel signal.

FIG. 5 depicts a preferred embodiment of the invention in an upmixing system for generating a centre channel signal exhibiting the advantages of the present invention, and it corresponds to a detailed view of FIG. 2B, wherein the detailed elements of intermediate processor 202 of FIG. 3 have also been depicted. As can be seen control processor 203 takes as input the input signals 102 and 104, and outputs, amongst other parameters, the gain coefficients gC1, gC2, gD1, gD2, adaptive filter coefficients as well as gain coefficients g1, g2.

Continuing from the explanation of FIG. 3, the third enhanced signal 346*c* is input into centre channel processor 205. Centre channel processor 205 comprises a processor for determining the dominant image direction 501 followed by a centre channel weighting processor 503. The dominant image direction processor 501 accepts as input information from at least one of the adaptive filters 318 and 320, or by analysis of the input signals Lo 102 and Ro 104.

In case information from the adaptive filters is used, such as the adaptive filter coefficients, the dominant direction may be determined using only one adaptive filter. In such case the level of just one filter relative to unity is used to determine the dominant direction. However, when only one filter is used, the dominant direction is calculated as the absolute energy level within a given frequency band for that filter. This method is not ideal as there may be zero signal energy at a given frequency in one channel, but a non-zero level in the other channel, and in such cases the dominant signal would be calculated incorrectly.

Hence, in an embodiment, the dominant direction is calculated as a level ratio of the two filters that can be operated in the frequency domain or band-limited time-domain, or in other words, as the average of the filter coefficients of both adaptive filters, thereby reducing the risk of incorrect calculation and increasing the quality of the dominant image direction determination. In another embodiment, the dominant image direction can also be calculated in a similar way by analysis of the original input signals.

Once the dominant image direction is determined, this information is passed to centre channel weighting coefficient, CCWC, processor 503, also known as spatial filter, where a coefficient for the intensity of the centre channel is determined. A high valued coefficient corresponds to a direction in a central location, which in one configuration is determined when the two adaptive filter coefficients AF_LS and AF_RS have essentially equal values (for example, the magnitude of the nth tap in a frequency domain representation of the both filters has the same value).

In one configuration, the centre channel weighting coefficient is determined according to the following formula:

$$CCWC=\max(0,\cos(\mathrm{abs}(d_wt/C)^N) \quad (7)$$

where d_wt is the average magnitude of the filter coefficients of both adaptive filters, N is a value to raise the power of the cosine value, which in one configuration is equal to 9, and C is a constant, which in one configuration is equal to 9 dB. This formula may also be expressed as the maximum value between zero and the cosine of the average magnitude of the filter coefficients of both adaptive filters, divided by a constant C, with the cosine value raised to the power of N. If a higher value of N is used, then the centre channel spatial width becomes narrower, that is, input signals must be panned very close to centre from the signal to be reproduced from the centre loudspeaker. Constant C likewise controls the spatial width for the centre channel, however does not change the shape of the spatial filter.

Alternatively, d_wt may be the absolute value of a single adaptive filter, in which case a CCWC value may be calculated twice, once per adaptive filter. The final CCWC weighting coefficient would then be determined as the average of these two intermediate CCWC values.

Figure 6:
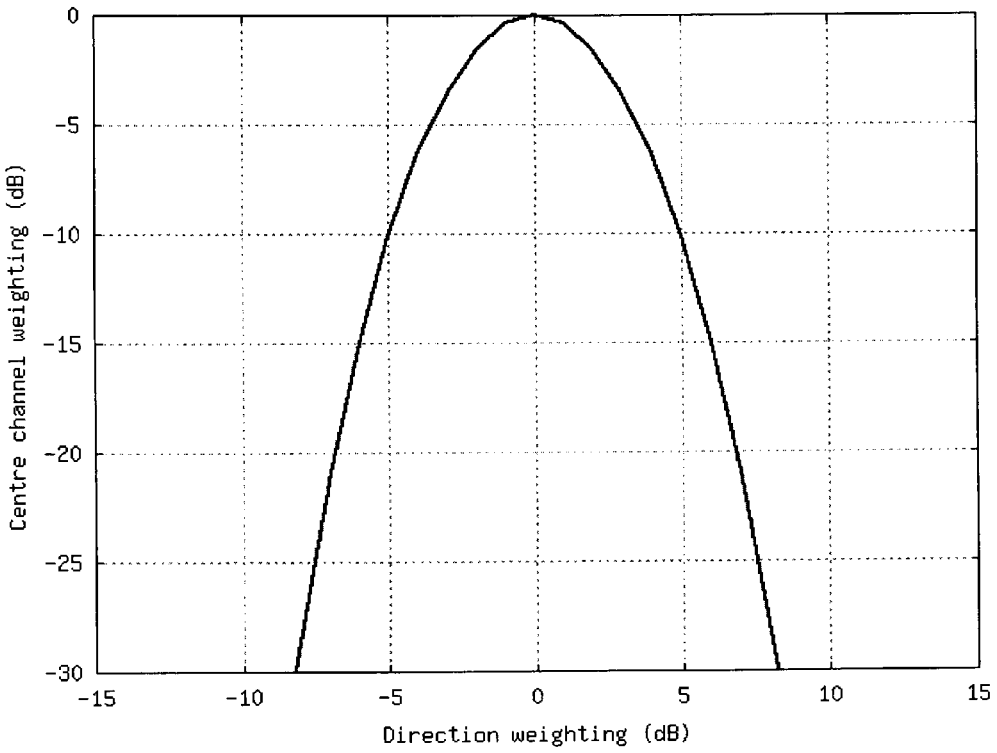
FIG. 6 depicts a centre channel weighting curve according to an aspect of the present invention.

FIG. 6 depicts a curve showing how the centre channel weighting coefficient is affected by the determined image direction. If the image direction is determined to be essentially equal to the direction of the physical loudspeaker, which in one configuration is determined when the magnitude of one adaptive filter is 20 dB greater than the other (which can occur if a sound source is hard-panned to one channel by a mixing engineer), then the centre channel weighting coefficient is set to a value substantially equal to zero. This ensures that for such "hard panned" instances, the output level of the centre channel will be zero, and the dominant image direction will be perceived as located in the direction of a single front left or right loudspeaker.

In another configuration, the image direction is determined to be essentially equal to zero degrees (that is, the CCWC value is set to be equal to its maximum value) if speech is detected in the intermediate signal 346.

With reference again to FIG. 5, the determined centre channel weighting coefficient CCWC is multiplied in multiplier 505 by the third enhanced signal 346*c* from the intermediate processor 202. The signal generated is the centre channel signal 206 ready to be applied to a suitable transducer such as a loudspeaker. Multiplier 505 may be implemented in the time domain or frequency domain in a manner well known to the person skilled in the art. As an example, multiplier may be implemented in the time domain as a convolution operation or in the frequency domain by frequency-dependent filters.

Since the summing of partially coherent data sequences results in a level increase of approximately 3 dB, a negative gain 507 may be optionally applied, that in one configuration is equal to a 3 dB attenuation, to compensate for this increase, to generate a modified output centre channel signal 346*c*.

It is noted that the adaptive filter coefficients, AF_LS and AF_RS, the gains g1 and g2, the determined dominant image direction and centre channel weighting coefficients CCWC can be represented as vectors having a single value or having a frequency-dependant representation (that is, for a frequency-dependant representation there are different vector values for different frequencies).

In summary, to generate the centre channel signal of the present invention involves at least the steps of combining the adaptive filtered input signals generated from two input signals to generate two combined signals, which are mixed to generate a third summed signal, this mixing may be implemented in varying proportions, and finally the third summed signal is weighted by a vector CCWC that considers the dominant direction of the front image, whereby if the dominant direction is determined to be substantially equal to zero (that is, the direction of the centre speaker) then the CCWC is high, and if the absolute value of the dominant direction is determined to be high then the CCWC is a low value.

The benefit of this novel method for generating a centre loudspeaker channel is that the adaptive filters align both the phase and magnitude of components in the input signals so that when the filtered signal is summed with the non-filtered signal, a summed signal is produced with minimal time-smearing artefacts and an increase in the ratio of correlated components to non-correlated components (that is, those components in the original input signals 102, 104 that are positively correlated). Hence a centre channel signal is generated which contains a stable non time-smeared image with a high quality natural sounding fidelity.

In the following an embodiment is described in detail in order to demonstrate the advantages of the centre channel signal generation of the present invention. For this embodiment audio input test signals are used that are typical for music, movie sound-track, and commercial voice audio.

For a given frequency range it may be assumed that the Ro input signal has a 3 dB boost and 0.5 ms advance relative to the Lo input signal, and that the Lo and Ro signals are correlated, such as would occur for a spaced 2-microphone recording or a single sound source, with the sound source closer to one microphone than the other, where the output of one microphone is the Lo signal and the output of the other microphone is the Ro signal.

With such signal conditions, then the second adaptive filter 320 will try to align these two signals by applying a 3 dB gain and 0.5 ms advance (that is, assuming that the delay of the Ro signal is greater than 0.5 ms, then this means that the time-domain peak in the second adaptive filter 320 will be such that the Lo channel is effectively advanced relative to the Ro signal). Considering the first adaptive filter 318 system for the same input signal, then the first adaptive filter 318 will have an inverse response to the second adaptive filter 320, that is a magnitude of −3 dB, and will have a time-domain peak in the first adaptive filter 318 such that the Ro channel is effectively delayed relative to the Lo signal.

However according to the centre channel generation system in FIG. 5 of the present invention, for the same situation where the Ro signal level was 3 dB greater than the Lo signal (say, 0 dBV), and that the second adaptive filter 320 filter response has a response peak of +3 dB, then the resulting signal level of the Lo signal filtered with the second adaptive filter 320 will be +3 dBV (we are also assuming that the cross-talk level set by gain gC1 is low, for example, −15 dB). The filtered Lo signal will also be time-shifted by 0.5 ms to align with the Ro signal, generating a new first summed signal.

Likewise, the second Ro signal is processed with the −3 dB second adaptive filter 320 and summed with the delay first Lo signal giving a second summed signal with a level of approximately 0 dB. However, since the first adaptive filter 318 will have a −0.5 ms delay, the second summed signal will be delayed by 0.5 ms relative to the first summed signal.

The centre channel weighting coefficient that is then applied to the centre channel is calculated from the level difference between the two channels. This can be calculated using one of, or both, of the frequency-dependant level differences between the two input signals or the level difference between the first 318 and second 320 adaptive filters.

As already mentioned, the centre channel weighting coefficient CCWC is calculated according to the following formula:

$$CCWC=\max(0,\cos(\mathrm{abs}(d_wt/C)^N) \quad (8)$$

where abs(d_wt) is the absolute value of the directional weighting value, in dB. The max( ) function returns the maximum value of the cos( ) function and zero, that is, bounding CCWC to a value between zero and unity. As discussed, a further gain reduction is applied to the summed signal from summer, applying a further gain, that is approximately equal to a 3 dB attenuation (this accounts for the fact that summed partially coherent data sequences give a level increase of approximately 3 dB).

As can be seen from the curve showing CCWC as a function of d_wt in FIG. 6, it can be seen that for a level of d_wt=3 dB or −3 dB, CCWC=−3.5 dB, and with the −3 dB further gain reduction, the net level of the centre channel signal for a highly correlated input signal is 8.5−3.5−3=2 dB. Hence, the centre channel is slightly softer than the level of the right channel (which has a +3 dB level for the portion under consideration, compared with a 0 dB level for the left channel). Therefore a perceptual sound image would be localized between the centre and right loudspeaker signal. Modifying the exponent value N in the above CCWC formula would modify the "sharpness" of the CCWC, that is, smaller value exponent increases CCWC as a function of abs(d_wt), so the centre channel level is higher for sources that are nearly hard-panned, giving a sound image that is localized closer to the centre loudspeaker. Changing the value of the exponent can be considered a divergence control controlling how much a mono or nearly-mono original input signal is sent to the centre channel relative to the front left and right channels of the upmixed audio system. This has the advantage that a user can control the sensitivity of the centre channel according to personal preferences.

Figure 7:
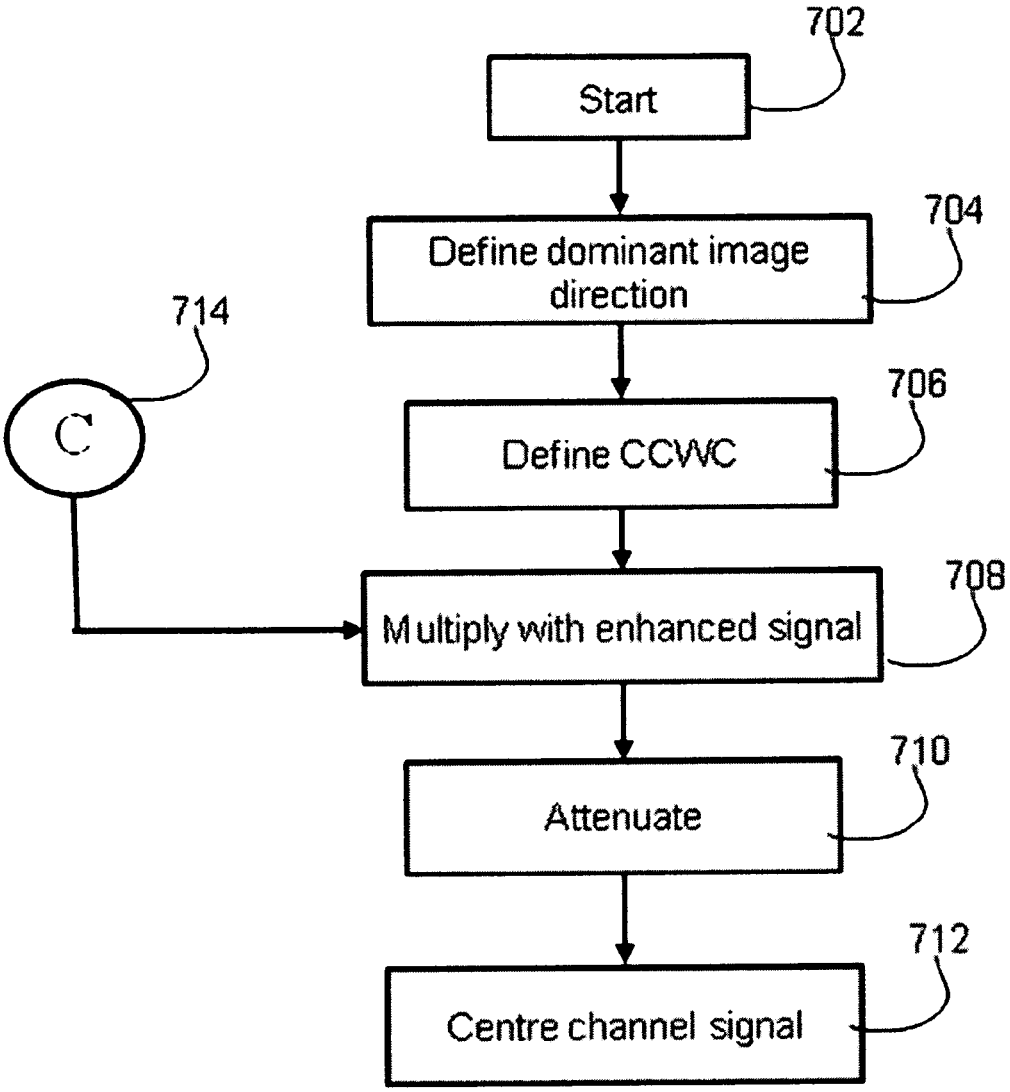
FIG. 7 is a flowchart representation of an aspect of the method of producing a centre channel signal according to an aspect of the present invention.

FIG. 7 is a flowchart representation of a process 700 for generating the centre channel signal. FIG. 7 represents amongst others also the steps taken by control processor 203 in performing various analysis, monitoring, controlling and parameter setting operations. The process 700 is represented as functional blocks, which may be implemented by various means. For example, these techniques may be implemented in hardware, software, firmware, or a combination thereof. As can be seen the process starts by determining 704 the dominant image direction and determining 706 the central channel weighting coefficient as explained earlier. The third enhanced signal 346*c* of FIG. 3 or FIG. 5 is received as depicted by circle C (corresponding to output circle C of process 400 of FIG. 4. The third enhanced signal 346*c* is multiplied 708 by the determined CCWC and attenuated 710 by attenuation coefficient in order to yield 712 the final centre channel output signal 206.

As mentioned the centre channel weighting coefficient is a result of calculating the magnitude of the first and second adaptive filters modified by a direction weighting component. The output is the output signal for the centre channel 206 ready to be applied to a suitable transducer such as a loudspeaker. Since the summing of partially coherent data sequences results in a level increase of approximately 3 dB, a further gain may be optionally applied 708, that in one embodiment is essentially equal to a 3 dB attenuation, to compensate for this increase, to generate a modified output centre channel signal exhibiting the advantages of the present invention.

The audio signal enhancing device, when used in conjunction with a centre channel processor, results in a centre channel audio signal without any time-smearing which closely follows the input signal's level and reproduces the original sound image with fidelity. As mentioned, the adaptive filters align both the phase and magnitude of components in the input signals so that when the filtered signal is summed with the non-filtered signal, a summed signal is produced with minimal time-smearing artefacts and comprising a high ratio of correlated components to non-correlated components.

Figure 8:
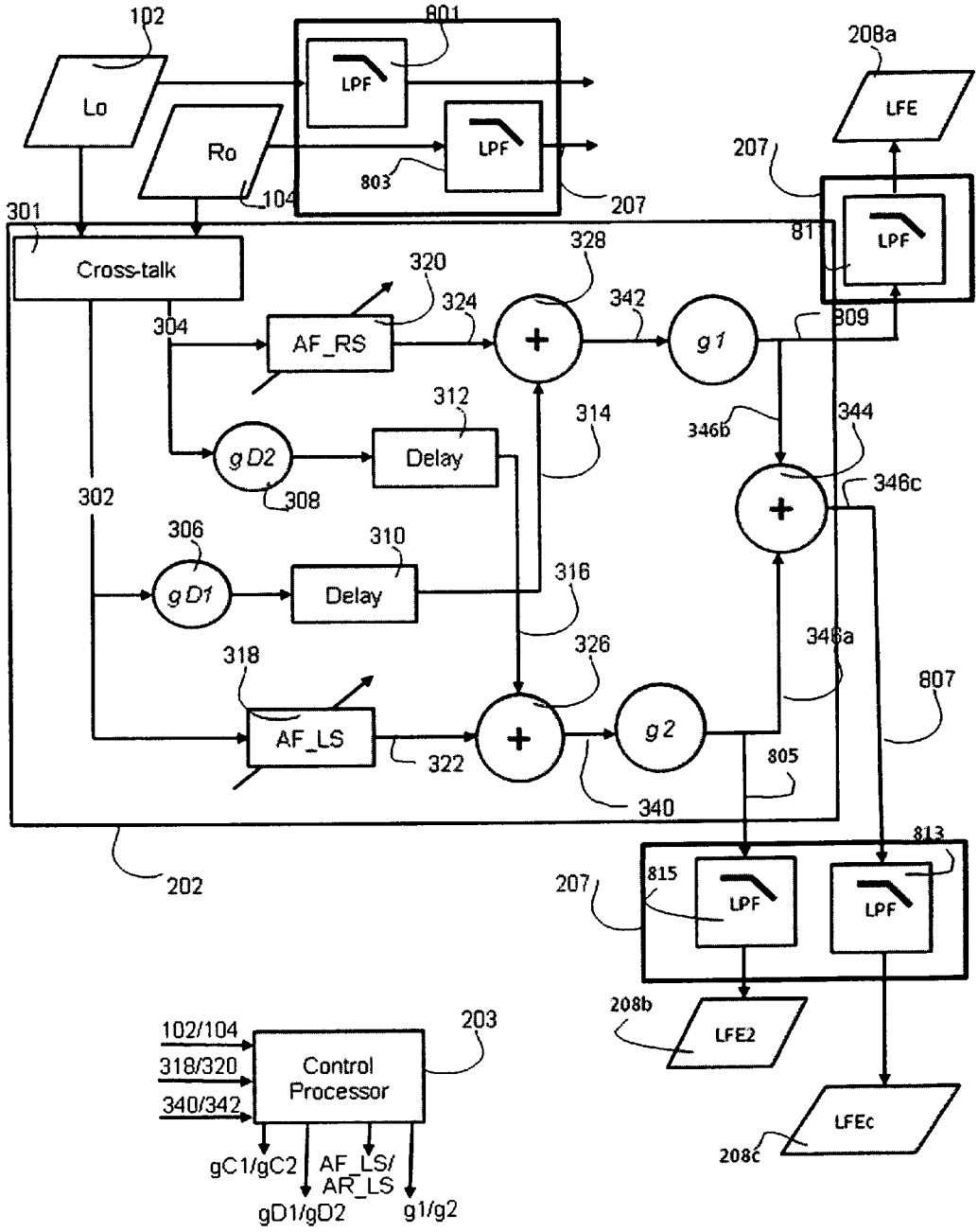
FIG. 8 depicts another aspect of the present invention, comprising details of the front channel processor for generating at least one low frequency effect subwoofer signal.

FIG. 8 depicts another embodiment of the invention in an upmixing system for generating at least one LFE subwoofer audio signal exhibiting the advantages of the present invention, and it corresponds to a detailed view of FIG. 2C, wherein the detailed elements of intermediate processor 202 of FIG. 3 have also been depicted. Although the configuration allows for only one subwoofer LFE signal 208*c* to be generated, it also allows for three subwoofer LFE signals 208 to be generated, comprising a first LFE1 208*a*, a second LFE2 208*b* and a third centre LFEc 208*c* subwoofer channel. As can be seen control processor 203 takes as input the two signals 102 and 104, and outputs, amongst other parameters, the gain coefficients gC1, gC2, gD1, gD2, adaptive filter coefficients as well as gain coefficients g1, g2.

According to this embodiment, the Lo 102 and Ro 104 input signals are first processed by low pass filters 801, 803, LPF, each, before being analyzed by the control processor 203 so that the level analysis performed by the control processor only takes the low frequency energy content into consideration.

In order to generate the different subwoofer channels 208, the LFE channel processor 207, which comprises a combination of low pass filters, acts on different points of the intermediate processor 202. As can be seen from FIG. 8, the third LFEc channel 208*c* is generated by low pass filtering the third enhanced signal 807. The LFE1 channel 208*a* is generated by low pass filtering the second enhanced signal 809 resulting from the application of gain coefficient g2 to the second summed signal 342. Likewise the LFE2 channel 208*b* is generated by low pass filtering the first enhanced signal 809 resulting from the application of gain coefficient g1 to the first summed signal 340. Each of these output signals can be reproduced with a subwoofer loudspeaker device allowing for a multi-subwoofer configuration as is found in some theatre systems.

Low pass filtering may be implemented in the digital domain, such as using digital finite impulse response FIR filters, or infinite impulse response IIR filters, or in the analogue domain. The cut-off frequency can be controlled by a user interface or set automatically, for instance with a −3 dB cut-off frequency of 75 Hz. Control processor may also perform the low pass filtering by setting the filter coefficients internally to undertake a low frequency weighting.

In situations where only a single subwoofer audio signal is necessary, the third LFEc signal 208*c* can be used, as this contains components of both the original left 102 and right 104 input signals.

Figure 9:
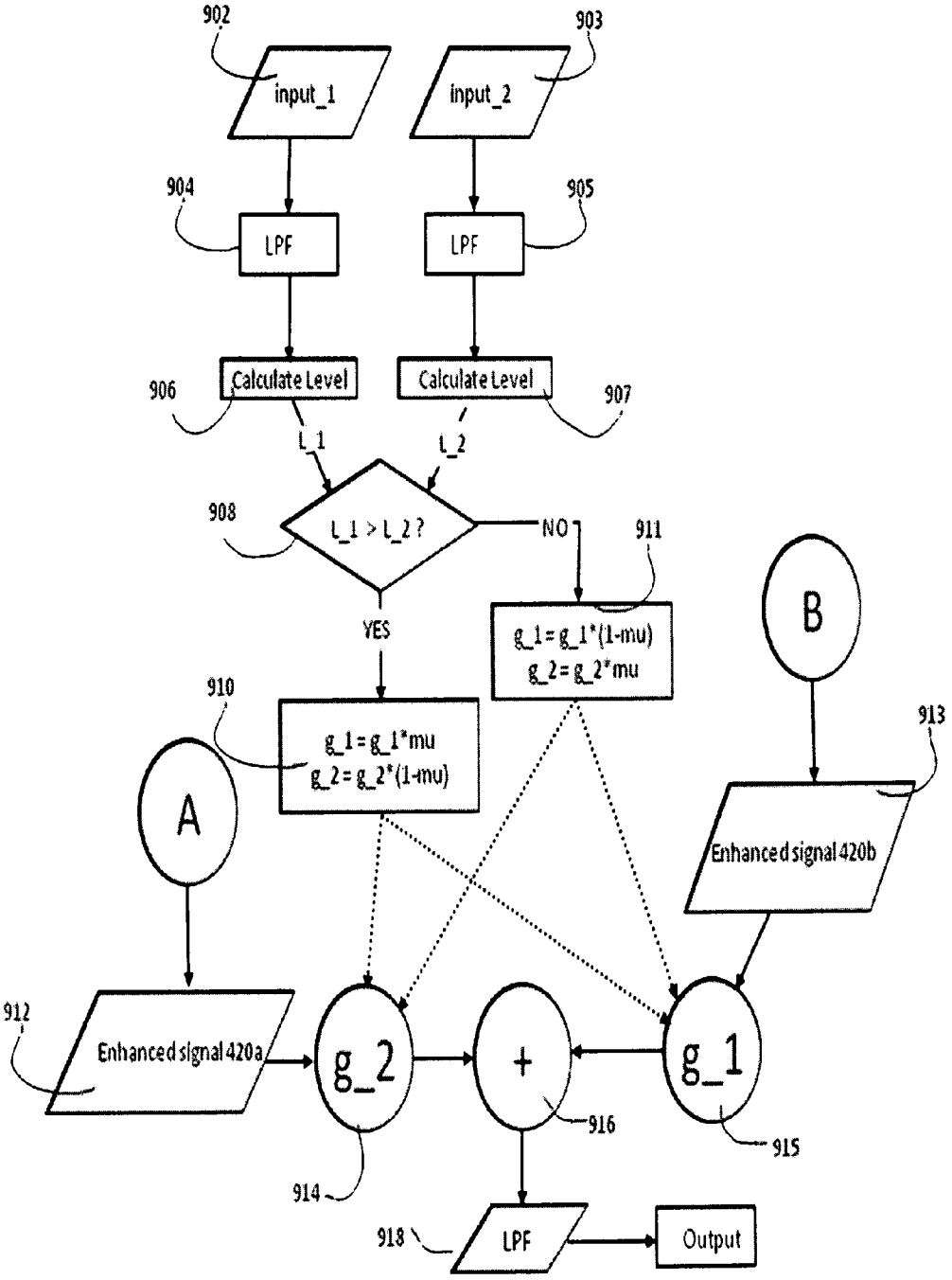
FIG. 9 is a flowchart representation of an aspect of the method of producing a at least one low frequency effect subwoofer signal according to an aspect of the present invention.

FIG. 9 is a flowchart representation of a process 900 for generating at least one LFE subwoofer signal. FIG. 9 represents amongst others also the steps taken by control processor 203 in performing various analyses, monitoring, controlling and parameter setting operations. The process 900 is represented as functional blocks, which may be implemented by various means. For example, these techniques may be implemented in hardware, software, firmware, or a combination thereof. As can be seen the process starts by first low pass filtering 904, 905, LPF, each received 902, 903 input signal. Control processor 203 subsequently analysis the levels of the low pass filtered signals by calculating 906, 908 the levels of two different signals. In step 908 a comparison is made to determine which of the two signals has a higher level and the control processor 203 acts to keep the loudest of the enhanced signals and discard the weakest of the enhanced signals.

In the situation where the enhanced signals have varying levels, and one continuously surpasses the other, the discarding of the weakest signal is not performed abruptly, but as a slow fade.

In case the first signal L1 has a higher level than the second signal L2 being compared, the first gain coefficient g1 is calculated as the last updated coefficient g1 multiplied by a parameter mu, and the second gain coefficient g2 is calculated as the last updated coefficient g2 multiplied by unity minus the parameter mu. In case L2 has a higher level than L1 the roles are reversed and the first gain coefficient g1 is calculated as the previous coefficient g1 multiplied by unity minus a parameter mu, and the second gain coefficient g2 is calculated as the previous coefficient g2 multiplied by the parameter mu, where parameter mu>1.

Subsequently both gain coefficients are applied to the combiners of FIG. 3 to yield the signals 805, 807 and 809 which are subsequently low pass filtered to be reproduced with a subwoofer loudspeaker device allowing for a multi-subwoofer configuration as is found in some theatre systems.

Control processor 203 determines the levels of the two input signals and sets the gain coefficient g1 to a large value and g2 to a low value depending on which of the two input signals is determined to have a larger signal level. This ensures that when there is an out-of-phase low frequency component in the original left and right input signals (as a result of a common audio mixing technique), the summation of the first and second summed signals will not cancel the out-of-phase low frequency component.

The audio signal enhancing device, and corresponding method, when used in conjunction with an LFE channel processor, results in a subwoofer audio signal where, since only the loudest level of two filtered signals is output, out of phase signals are not cancelled and the resulting level of the output channel is proportional to the original low frequency content in the original input signals.

Therefore, the devices and methods of the present invention provide a variety of advantageous characteristics, amongst them the enhancement of a stereophonic audio signal comprising two signals into at least one enhanced signal wherein out of phase signals are not cancelled, and the resulting level of the output channel is proportional to the original low frequency content in the original input signals. Hence the resulting signal will not contain time-smearing and the dominant component (at a given frequency) is equal in both signals, and the level of the new dominant signal has the same level as in the original two input signals.

This, when applied to the centre channel processor generates a centre channel signal comprising a balanced dominant component without any time-smearing which closely follows the input signal's level with minimal time-smearing artefacts and comprising a high ratio of correlated components to non-correlated components.

Likewise, this enhanced signal, when applied to the low frequency effects processor generates at least one subwoofer signal wherein out of phase signals are not cancelled and the resulting level of the output channel is proportional to the original low frequency content in the original input signals. A plurality of LFE signals may also be generated from the plurality of enhanced signals generated by the audio signal enhancing device of the present invention.

It is to be understood by the skilled person in the art that the disclosure of the various embodiments of the invention is intended as non-limitative preferred examples and realisations of the inventions, and therefore features of different embodiments may be readily combined within the scope of the general inventive concept described.

It is to be understood that the embodiments described herein may be implemented by hardware, software, firmware, middleware, microcode, or any combination thereof. When the systems and/or methods are implemented in software, firmware, middleware or microcode, program code or code segments, a computer program, they may be stored in a machine-readable medium, such as a storage component. A computer program or a code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted using any suitable means including memory sharing, message passing, token passing, network transmission, etcetera.

For a software implementation, the techniques described herein may be implemented with modules (e.g., procedures, functions, and so on) that perform the functions described herein. The software codes may be stored in memory units and executed by processors. The memory unit may be implemented within the processor or external to the processor, in which case it can be communicatively coupled to the processor through various means as is known in the art. Further, at least one processor may include one or more modules operable to perform the functions described herein.

Moreover, various aspects or features described herein may be implemented as a method, apparatus, or article of manufacture using standard programming and/or engineering techniques. The term "article of manufacture" as used herein is intended to encompass a computer program accessible from any computer-readable device, carrier, or media. For example, computer-readable media can include but are not limited to magnetic storage devices (e.g., hard disk, floppy disk, magnetic strips, etc.), optical disks (e.g., compact disk (CD), digital versatile disk (DVD), etc.), smart cards, and flash memory devices (e.g., EPROM, card, stick, key drive, etc.). Additionally, various storage media described herein can represent one or more devices and/or other machine-readable media for storing information. The term "machine-readable medium" can include, without being limited to, various media capable of storing, containing, and/or carrying instruction(s) and/or data. Additionally, a computer program product may include a computer readable medium having one or more instructions or codes operable to cause a computer to perform the functions described herein.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within scope of the appended claims. To the extent that the term "includes" is used in either the detailed description or the claims, such term is intended to be inclusive in a manner similar to the term "comprising" as "comprising" is interpreted when employed as a transitional word in a claim.

The various logical blocks, modules, and circuits described in connection with the embodiments disclosed herein may be implemented of performed with a general purpose processor, a digital signal processor (DSP), and application specific integrated circuit (ASIC), a field programmable gate array (FPGA), or other programmable logic device, discrete gate or transistor logic, discrete hardware components, or any combination thereof designed to perform the functions described. A general-purpose processor may be a microprocessor, but in the alternative, the processor may be any conventional processor, controller, microcontroller, or state machine.

The methods or algorithms described may be embodied directly in hardware, in a software module executed by a processor, or a combination of the two. A software module may reside in RAM memory, flash memory, ROM memory, EPROM memory, EEPROM memory, registers, hard disk, a removable disk, a CD-ROM, or any other form of storage medium known in the art.

Those skilled in the art should appreciate that the foregoing discussion of one or more embodiments does not limit the present invention, nor do the accompanying figures. Rather, the present invention is limited only by the following claims.

The invention claimed is:

1. An audio signal enhancing device for upmixing a stereophonic input signal comprising two audio signals, the device comprising:

signal enhancement means for processing the two input signals to generate at least one enhanced signal, the signal enhancement means comprising:

two parallel processing lines comprising two parallel processing branches each;

the first processing branch comprising adaptive filter means; and the second processing branch comprising means for delaying a signal;

means for combining the output signal of the first processing branch of the first processing line with the output signal of the second processing branch of the second processing line to generate a first enhanced signal;

means for combining the output signal of the first processing branch of the second processing line with the output signal of the second processing branch of the first processing line to generate a second enhanced signal;

means for combining the first and second enhanced signals to generate a third enhanced signal;

means for determining a dominant image direction of the third enhanced signal to determine a centre channel weighting coefficient that determines an output level of a centre channel to create a perception of sound location as in the direction of a single front side loudspeaker; and control means for controlling the signal enhancement means.

2. The audio signal enhancing device of claim 1, wherein the control means is adapted:

to analyse the input signals, the output of the first and second processing branches of the first and second processing lines, the at least one enhanced signal, the first, second and third enhanced signals; and to dynamically vary the gain and delay coefficients of the signal enhancement means.

3. The audio signal enhancing device of claim 2 wherein each of the means for combining comprise respective weighted summing operations.

4. The audio signal enhancing device of claim 2 wherein the adaptive filter means comprises adaptive filter coefficient setting means and wherein the adaptive filter coefficients are set by the control means.

5. The audio signal enhancing device of claim 2 wherein the second processing branch further comprises multiplying means for applying at least one gain coefficient to the third and fourth signals and wherein the at least one gain coefficient and the amount of delay for the means for delaying the signal is set by the control means.

6. The audio signal enhancing device of claim 2 further comprising: multiplying means for applying at least one gain coefficient to the first and second enhanced signals and wherein the at least one gain coefficient is set by the control means; and first and second adaptive filters wherein the dominant image direction is calculated as an average of the filter coefficients of both the first and second adaptive filters.

7. The audio signal enhancing device of claim 2 further comprising centre channel signal generating means for generating a centre channel signal from the third enhanced signal, the centre channel signal generating means comprising centre channel weighting means and multiplying means for applying the centre channel weighting coefficient to the third enhanced signal and wherein the centre channel signal generating means is controlled by the control means.

8. The audio signal enhancing device of claim 2 further comprising low frequency effects subwoofer signal generating means for generating at least one low frequency effects subwoofer signal from the at least one enhanced signal, the low frequency effects subwoofer signal generating means comprising low pass filter means and wherein the low frequency effects subwoofer signal generating means is controlled by the control means.

9. The audio signal enhancing device of claim 2 wherein the dominant direction is calculated as a level ratio of two filters, and wherein a centre channel weighting coefficient corresponding to the level ratio may range from zero indicating a perceived sound location from one of a sin le front left or front right loudspeaker, to a value greater than zero indicating at least a portion of the perceived sound location from a center loudspeaker in addition to the sin be front side loudspeaker.

10. A method for enhancing a stereophonic input signal comprising two audio signals for upmixing, the method comprising:

processing the two input signals to generate at least one enhanced signal in two parallel processing lines comprising two parallel processing branches each;

the first processing branch comprising adaptive filtering the signals; and the second processing branch comprising delaying the signals;

the processing the two input signals comprising:

combining the output signal of the first processing branch of the first processing line with the output signal of the second processing branch of the second processing line to generate a first enhanced signal;

combining the output signal of the first processing branch of the second processing line with the output signal of the second processing branch of the first processing line to generate a second enhanced signal;

combining the first and second enhanced signals to generate a third enhanced signal;

determining a dominant image direction of the third enhanced signal to determine a centre channel weighting coefficient that determines an output level of a centre channel to create a perception of sound location as in the direction of a single front side loudspeaker ;and controlling the processing to generate at least one enhanced signal.

11. The method of claim 10, wherein controlling the processing comprises analyzing the input signals, the output of the first and second processing branches of the first and second processing lines, the at least one enhanced signal, the first, second and third enhanced signals; and dynamically varying the gain and delay coefficients of the signal enhancement means, and wherein each of the combining steps comprise respective weighted summing operations.

12. The method of claim 11 further comprising adding a portion of the first input signal to the second input signal to generate a third signal for feeding into the first processing line and adding a portion of the second input signal to the first input signal to generate a fourth signal for feeding into the second processing line.

13. The method of claim 11 further comprising generating a centre channel signal from the third enhanced signal by determining a centre channel weighting coefficient and multiplying the third enhanced signal by the centre channel weighting coefficient to generate a centre channel signal for output through a centre channel speaker, and wherein the dominant direction is calculated as a level ratio of two filters, and wherein a centre channel weighting coefficient corresponding to the level ratio may range from zero indicating a perceived sound location from one of a single front left or front right loudspeaker, to a value greater than zero indicating at least a portion of the perceived sound location from a center loudspeaker in addition to the single front side loudspeaker.

14. The method of claim 11 further comprising generating at least one low frequency effects subwoofer signal from the at least one enhanced signal comprising low pass filtering the input signals and the at least one enhanced signal, and further comprising first and second adaptive filters, wherein the dominant image direction is calculated as an average of the filter coefficients of both the first and second adaptive filters.

15. A centre channel generation device for generating a centre channel signal from a stereophonic input signal comprising two audio signals, the centre channel generation device comprising the audio signal enhancing device of claims 1 to 9 wherein the centre channel weighting coefficient is applied to a centre channel processor configured to produce a balanced dominant component that follows a level of an input signal with minimal time-smearing artifacts and comprising a high ratio of correlated components to non-correlated components.

16. A low frequency effects LFE subwoofer signal generation device for generating a subwoofer signal from a stereophonic input signal comprising two audio signals, the LFE subwoofer signal generation device comprising the audio signal enhancing device of claims 1 to 9 and further comprising:

means for low pass filtering the two audio signals to generate filtered signals, wherein the control means analyses the filtered signals for controlling the audio signal enhancing device; and means for low pass filtering at least one enhanced signal to generate at least one low frequency signal.

17. A non-transitory computer readable medium having stored thereon instructions which, when executed on a machine, perform the steps of any one of method claims 10 to 14.

18. An audio signal upmixer for generating at least three output audio signals from a stereophonic input signal comprising two audio input signals, the audio signal upmixer comprising the audio signal enhancing device of claim 1 and configured to perform the steps of:

processing two signals, being generated from the two audio input signals, to generate at least one enhanced signal in two parallel processing lines comprising two parallel processing branches each by processing one signal by the first parallel processing line and the other signal by the second parallel processing line; the first processing branch comprising adaptive filtering the signals; and the second processing branch comprising delaying the signals; the processing comprising:

combining, by a weighted summing operation, the output signal of the first processing branch of the first processing line with the output signal of the second processing branch of the second processing line to generate a first enhanced signal;

combining, by a weighted summing operation, the output signal of the first processing branch of the second processing line with the output signal of the second processing branch of the first processing line to generate a second enhanced signal; and combining, by a weighted summing operation, the first and second enhanced signals to generate a third enhanced signal; and controlling the processing to generate at least one enhanced signal, wherein controlling the processing comprises:

analyzing at least one of the input audio signals, at least one of the signals of the first and second processing branches of the first and second processing lines, and at least one enhanced signal; and dynamically varying at least one of the adaptive filtering coefficients, the gain coefficients (gD1, gD2; g1, g2) of multiplying means, or the amount of delay for the means for delaying the signal of the signal enhancement means.

* * * * *